US008448747B2

(12) United States Patent
Gluchowski

(10) Patent No.: US 8,448,747 B2
(45) Date of Patent: May 28, 2013

(54) TEMPORARY SCAFFOLDING SYSTEM

(76) Inventor: John Gluchowski, Bayport, NY (US)

( * ) Notice: Subject to any disclaimer, the term of this patent is extended or adjusted under 35 U.S.C. 154(b) by 0 days.

(21) Appl. No.: 12/640,781

(22) Filed: Dec. 17, 2009

(65) Prior Publication Data

US 2010/0116591 A1 May 13, 2010

Related U.S. Application Data

(62) Division of application No. 11/183,543, filed on Jul. 13, 2005, now abandoned.

(60) Provisional application No. 60/588,510, filed on Jul. 15, 2004.

(51) Int. Cl.
*E04G 3/30* (2006.01)
*E04G 7/00* (2006.01)

(52) U.S. Cl.
USPC ..... 182/150; 403/385

(58) Field of Classification Search
USPC ..... 182/150; 403/385
See application file for complete search history.

(56) References Cited

U.S. PATENT DOCUMENTS

| | | | | |
|---|---|---|---|---|
| 842,382 | A | 1/1907 | Clark | |
| 1,706,215 | A * | 3/1929 | Davidson | 403/97 |
| 1,750,269 | A | 3/1930 | Johnston | |
| 2,198,960 | A * | 4/1940 | Deck | 182/113 |
| 2,524,302 | A | 10/1950 | Mack | |
| 2,611,458 | A | 9/1952 | Hammit et al. | |
| 2,894,773 | A * | 7/1959 | Noe | 403/385 |
| 2,960,721 | A | 11/1960 | Schnaitter et al. | |
| 3,700,071 | A * | 10/1972 | Kikuchi | 182/150 |
| 3,830,520 | A | 8/1974 | Kelly | |
| 4,388,982 | A | 6/1983 | Yonahara | |
| 5,118,147 | A | 6/1992 | Correll | |
| 6,561,473 | B1 * | 5/2003 | Ianello | 248/219.4 |

FOREIGN PATENT DOCUMENTS

| | | | |
|---|---|---|---|
| JP | 03103568 | A * | 4/1991 |
| JP | 2001-199671 | | 7/2001 |

* cited by examiner

*Primary Examiner* — Alvin Chin Shue
(74) *Attorney, Agent, or Firm* — Ostrolenk Faber LLP

(57) ABSTRACT

A scaffolding system in which a platform or wall may be secured to a crosspiece supported by cables near an angled structure or in another difficult location. A platform is secured to the crosspiece horizontally, while a wall is secured vertically. The crosspiece may be an angle iron or pipe, for example. Also disclosed are clamps and clamping arrangements for securing the platform or wall to the crosspiece.

4 Claims, 9 Drawing Sheets

TEMPORARY SCAFFOLDING SYSTEM

CROSS REFERENCE TO RELATED APPLICATION

The present application is a Divisional Application of U.S. Ser. No. 11/183,543 filed Jul. 13, 2005, which application claims the benefit and priority of U.S. Provisional Application Ser. No. 60/588,510 filed Jul. 15, 2004, all incorporated herein by reference.

BACKGROUND OF THE INVENTION

1. Field of the Invention

The invention relates to a temporary scaffolding system, and more particularly to a clamping system for use with the scaffolding system.

2. Related Art

It is difficult to mount conventional temporary scaffolding securely to an angled structure such as an angled or tapered tower or other structural member. Either the scaffolding system cannot clamp to an angled structure, or the angled structure may have braces that obstruct the clamping. A structure such as a tower also lacks horizontal surfaces for providing support.

SUMMARY OF THE INVENTION

The invention avoids these problems by utilizing cables that can be hung either surrounding or adjacent to an angled structure, thereby permitting a support for a temporary platform to be clamped to the cables.

Another aspect of the invention is a clamp that can be fastened securely to a cable at a range of angles, providing additional flexibility to the scaffolding system.

Other features and advantages of the present invention will become apparent from the following description of the invention which refers to the accompanying drawings.

DETAILED DESCRIPTION OF EMBODIMENTS OF THE INVENTION

Figure 1:
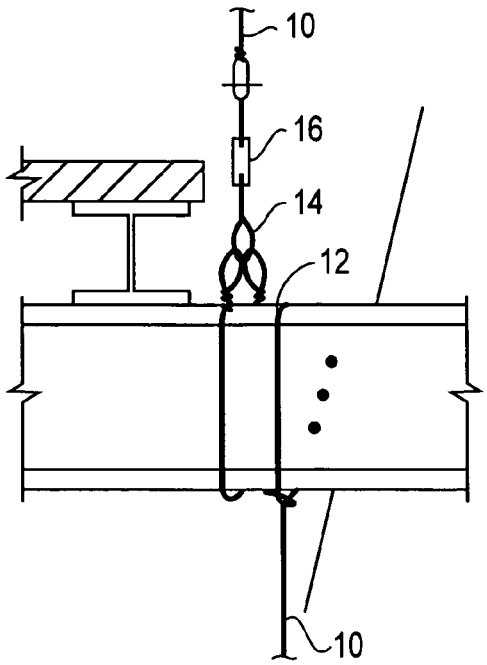
FIG. 1 is a view showing vertical cables secured to a beam in a first embodiment.
Figure 2:
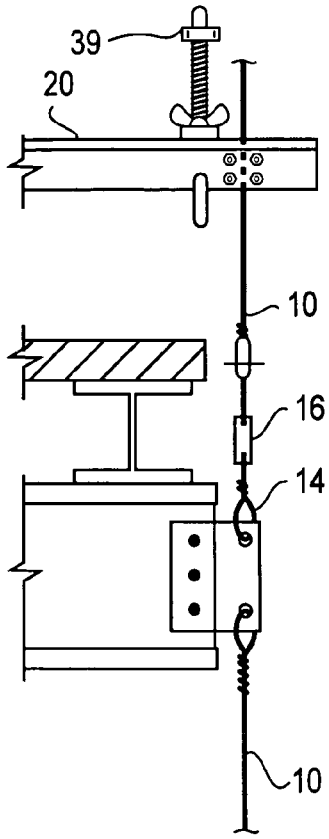
FIG. 2 is a view showing vertical cables secured to the beam in a variation of the first embodiment, and an angle iron secured to one of the cables.

As shown in FIGS. 1 and 2, vertical cables 10 are secured, for example by conventional loops 12 and/or shackles 14, to existing horizontal members of a structure such as beam 18. The cables 10 are tensioned with turnbuckles 16 or by any other suitable means, to increase the rigidity of the scaffolding system.

Figure 3:
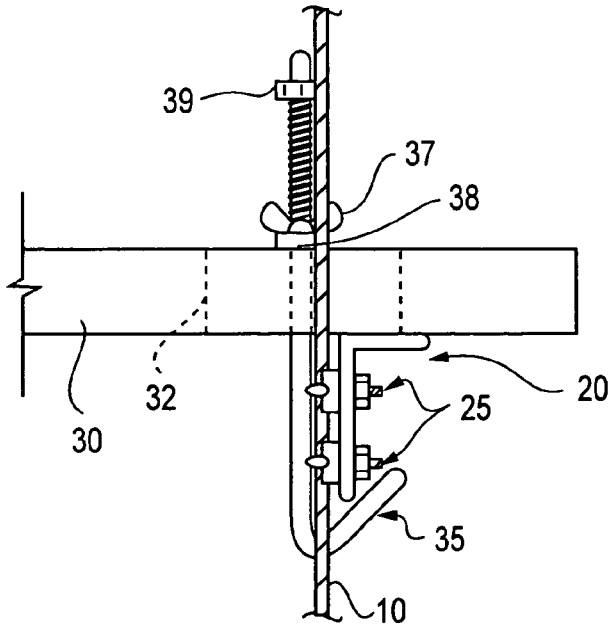
FIG. 3 is a detail view showing the angle iron secured to the cable as in FIG. 2, and a temporary platform on the angle iron.

The beam 18 is of course capable of supporting a load, but is not in the location where a temporary platform is needed. Therefore, as shown in FIGS. 2 and 3, to support a temporary platform where it is needed, an angle iron 20 is secured to a cable 10. Preferably the angle iron 20 is secured to the cable 10 at at least two points on the angle iron 20 as shown. In this example, a pair of conventional Crosby clamps 25 or any other suitable devices are used to secure the angle iron 20 to the cable 10.

Another portion of the angle iron 20, such as an opposite end, is secured to another cable (not shown) so that the angle iron 20 is thereby secured in a horizontal position.

The angle iron 20 supports a temporary work platform 30 such as a plank, extending transversely to the angle iron 20.

A J-bolt 35 extends downward through a hole 32 in the platform 30 to clamp the platform 30 onto the angle-iron 20. The "J" of the J-bolt 35 hooks around the angle iron. At the other end of the J-bolt 35, on the top side of the platform 30, a wing nut 37 along with a washer 38 and a Teflon stop nut 39 complete the clamping arrangement.

Figure 4:
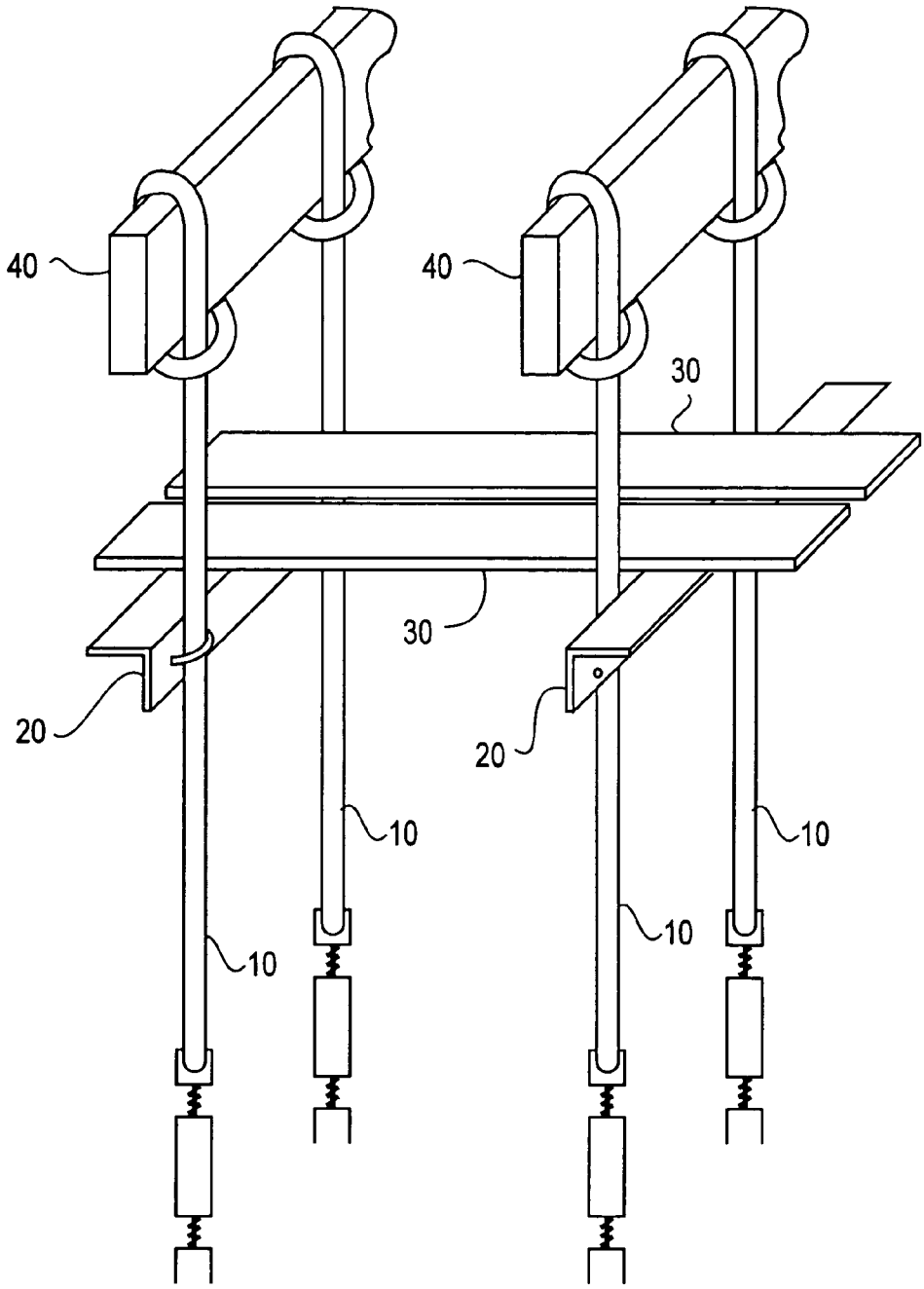
FIG. 4 is a perspective view based on FIG. 3, showing a plurality of angle irons supporting a temporary platform.

FIG. 4 is a perspective view showing an arrangement of four cables 10, two horizontal structural members 40, two angle irons 20, and two planks 30 secured to the angle irons to form a temporary work platform.

Figure 5:
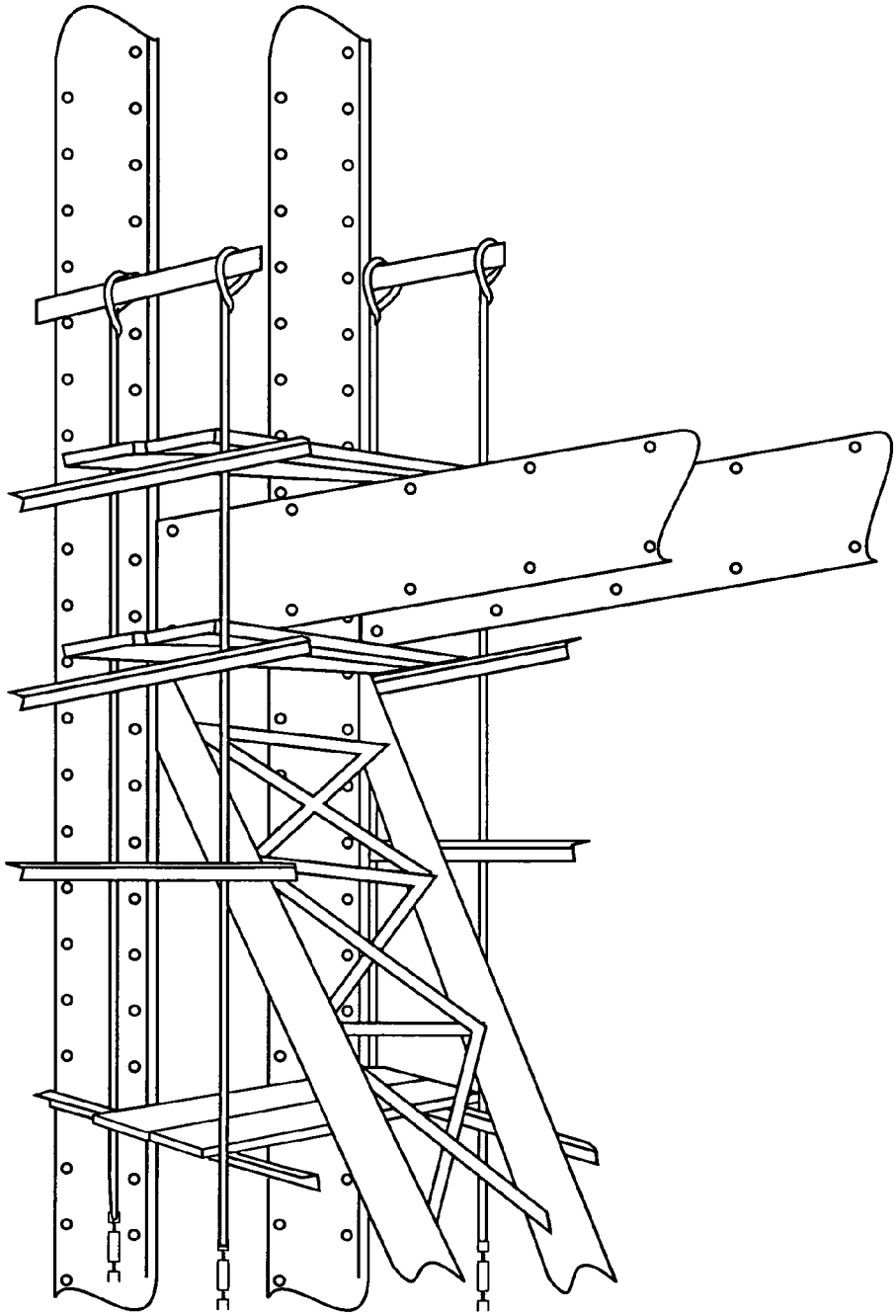
FIG. 5 shows a plurality of platforms as in FIG. 4, supported on a bridge.

FIG. 5 is a perspective view showing an example of how the arrangement of FIGS. 1-4 can effectively provide temporary work platforms around and among the tapered vertical towers as well as other angled and horizontal members of a bridge.

Figure 6:
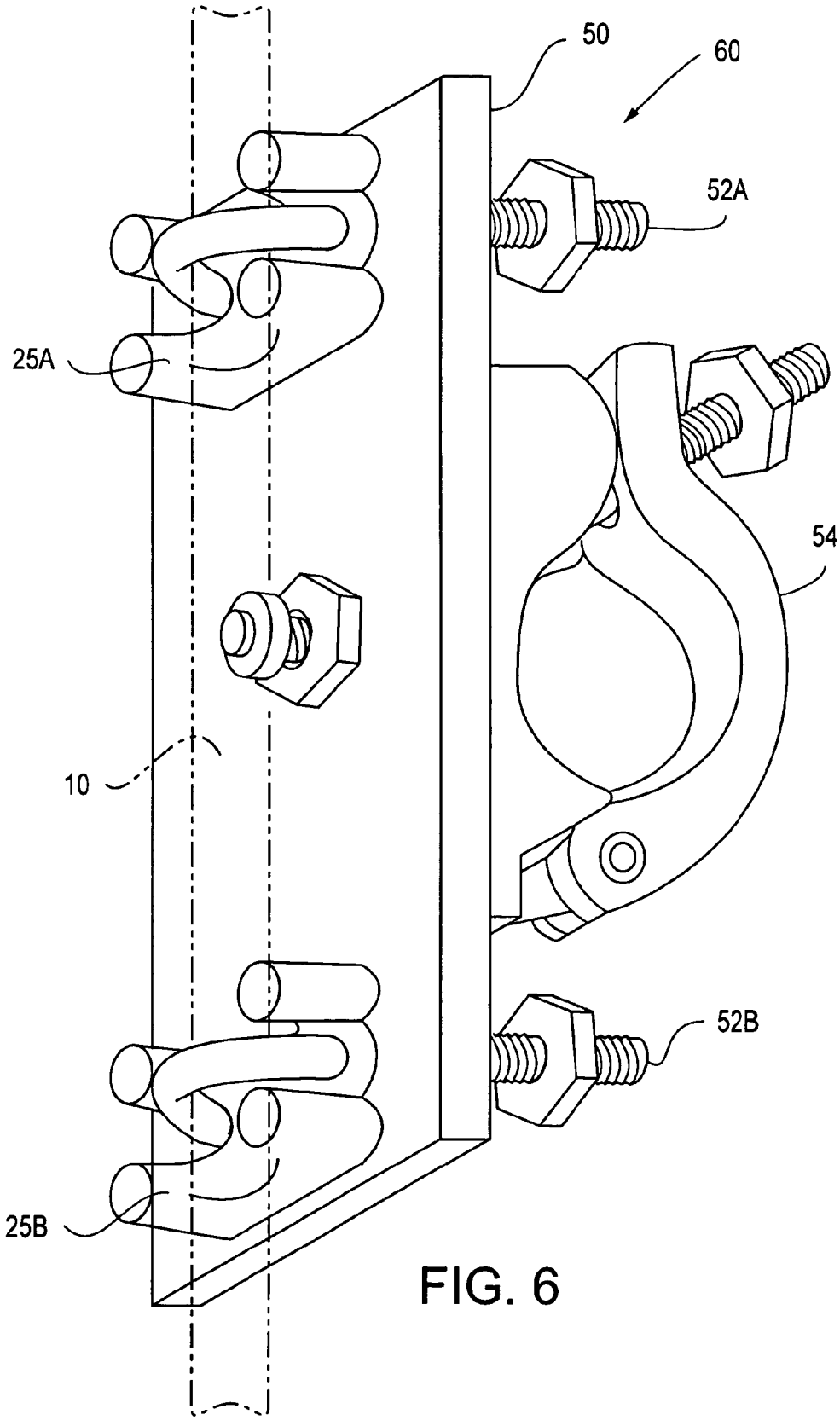
FIG. 6 shows another embodiment, namely a clamp for securing a pipe or the like to a cable.

FIG. 6 shows a second aspect of the invention, namely a clamp 60 for use in the scaffolding arrangement. The cable 10 is secured by a pair of Crosby clamps 25A and 25B to a plate 50. The Crosby clamps are secured to the plate by U-bolts 52A and 52B. A pipe clamp 54 is bolted to the other side of the plate. The Crosby clamps permit the clamp 60 to rotate to any position about the cable, giving the clamp increased flexibility of use.

The pipe clamp 54 is used to hold a pipe or other member (not shown) which serves the same function as the angle iron in the first embodiment of the invention, for supporting a temporary work platform via J-bolts or any other suitable device.

FIGS. 7-10 show a scaffolding arrangement according to another embodiment of the invention, in which a supporting pipe may be mounted directly to a cable. Four cables 10 are shown. Two pipes 70 are each secured to a respective pair of the cables 10 by fasteners such as U-bolts or Crosby clamps 72 and matching nuts 74. The clamps 60 shown in FIG. 6 could optionally be used to secure the pipes to the cables.

The pipes 70 are preferably flattened or crimped as shown at 76, both to facilitate forming the holes for the fasteners 72 and to improve the grip between the pipe and the cable 10.

Figure 7:
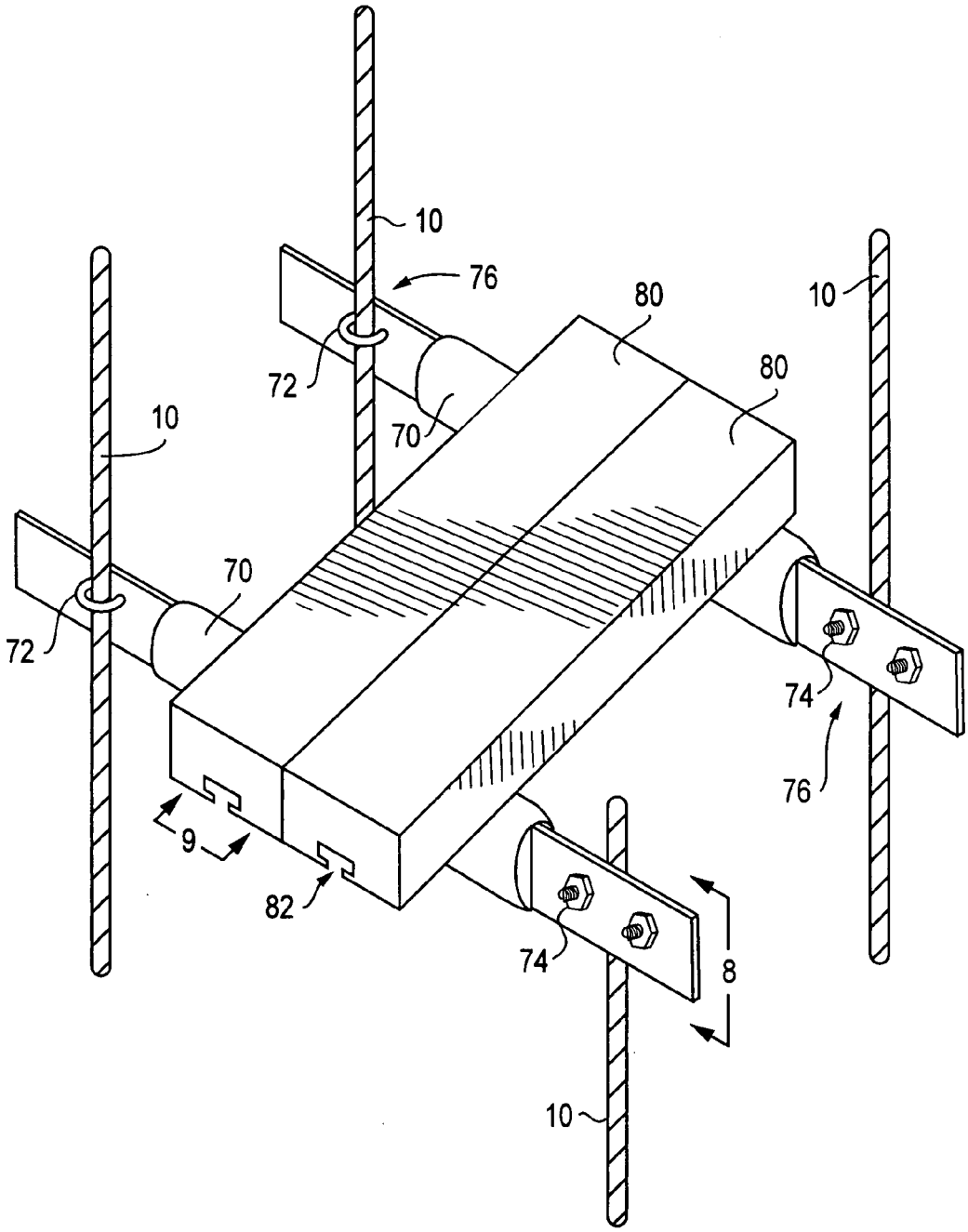
FIG. 7 shows a further embodiment, comprising a pair of pipes secured to cables and supporting a platform.
Figure 8:
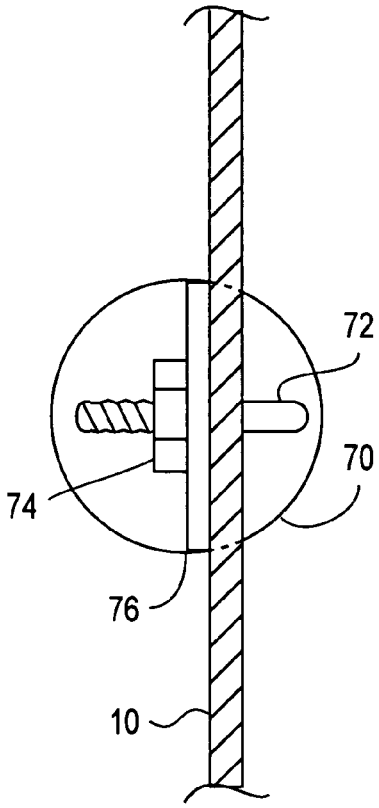
FIG. 8 is a detail view taken in direction "8" in FIG. 7.
Figure 9:
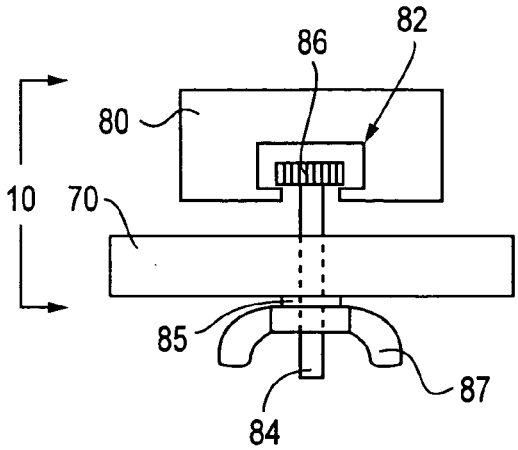
FIG. 9 is a sectional view taken in direction "9" in FIG. 7.
Figure 10:
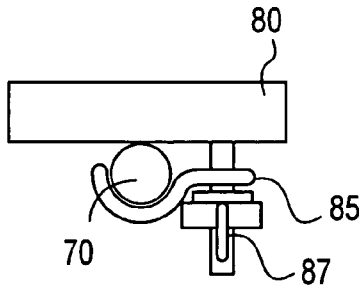
FIG. 10 is a sectional view taken in direction "10" in FIG. 9.

FIG. 8 is a detail view taken in direction "8" in FIG. 7.

A pair of scaffold planks 80 form a temporary work platform. Each plank has a track 82. The track is better seen in FIG. 9, which is a sectional view taken in direction "9" in FIG. 7, and FIG. 10, which is a sectional view taken in direction "10" in FIG. 9. A bolt 84 has a bolt head 86 inserted in the track 82. The bolt is secured to the pipe 70 by a J-hook 85 which is secured by a wing-nut 87 to clamp the pipe 70 against the plank 80.

Figure 11:
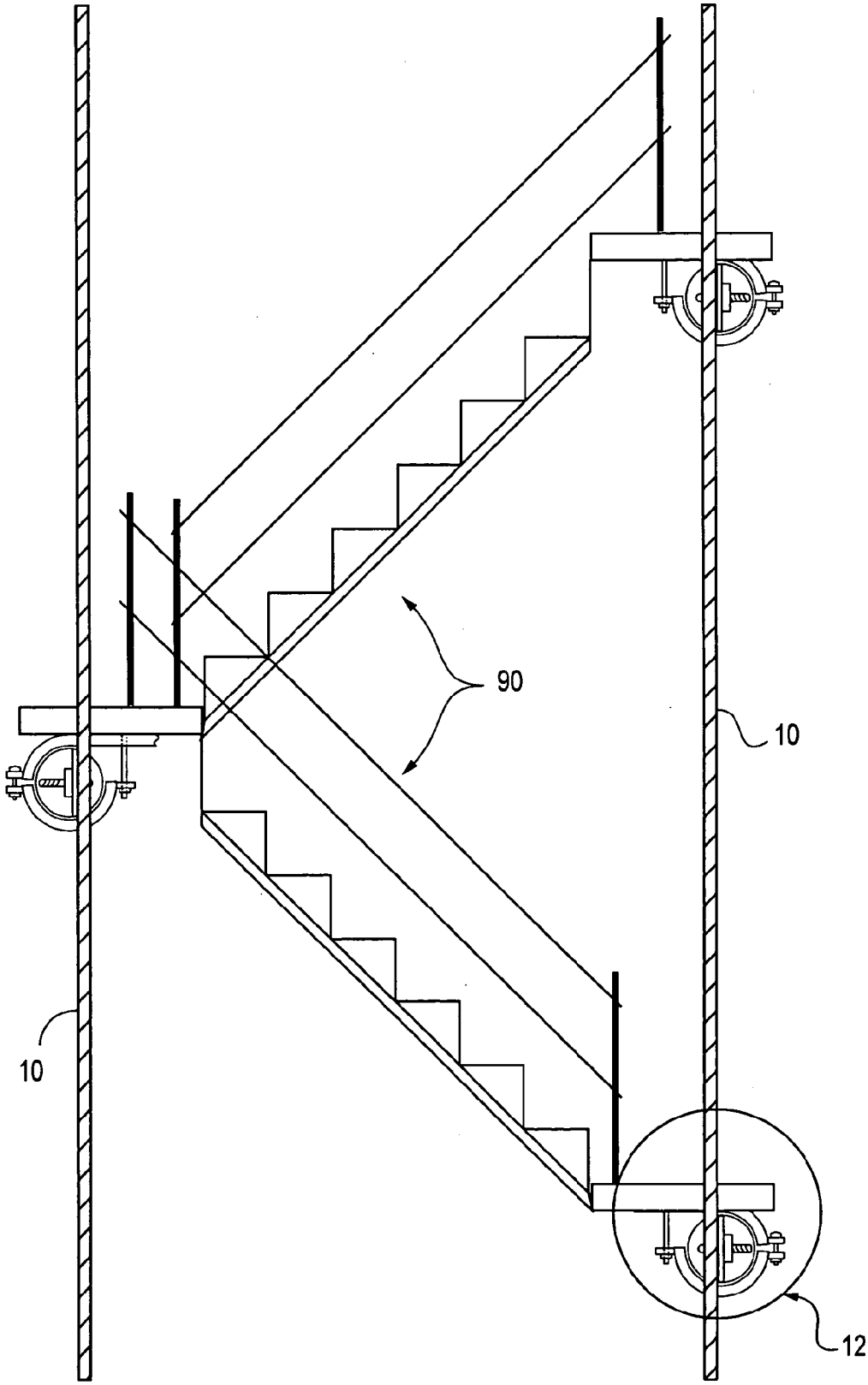
FIG. 11 shows another embodiment, comprising a scaffold stairway supported on cables.
Figure 12:
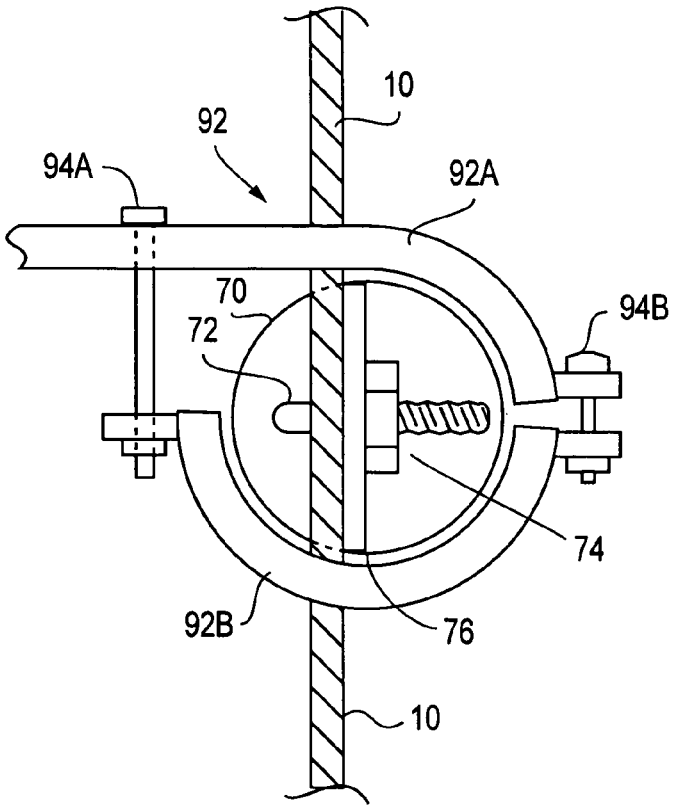
FIG. 12 is a detail view of a clamping arrangement in FIG. 11.

FIGS. 11-12 show a further aspect of the invention, in which a scaffold stairway may be mounted to cables. Cables 10 (only two being shown in FIG. 11) have pipes 70 mounted on the cables as shown in FIG. 7. Two scaffold stairways 90 are supported on the cables 10 by a clamping arrangement shown in detail in FIG. 12.

Specifically, a pipe clamp 92 is attached to the stairway 90 by a method such as welding, or may be integrally formed with the stairway 90. A top clamp half 92A and a bottom clamp half 92B are secured together by bolts 94A, 94B to clamp the stairway 90 to the pipe 70.

Figure 13:
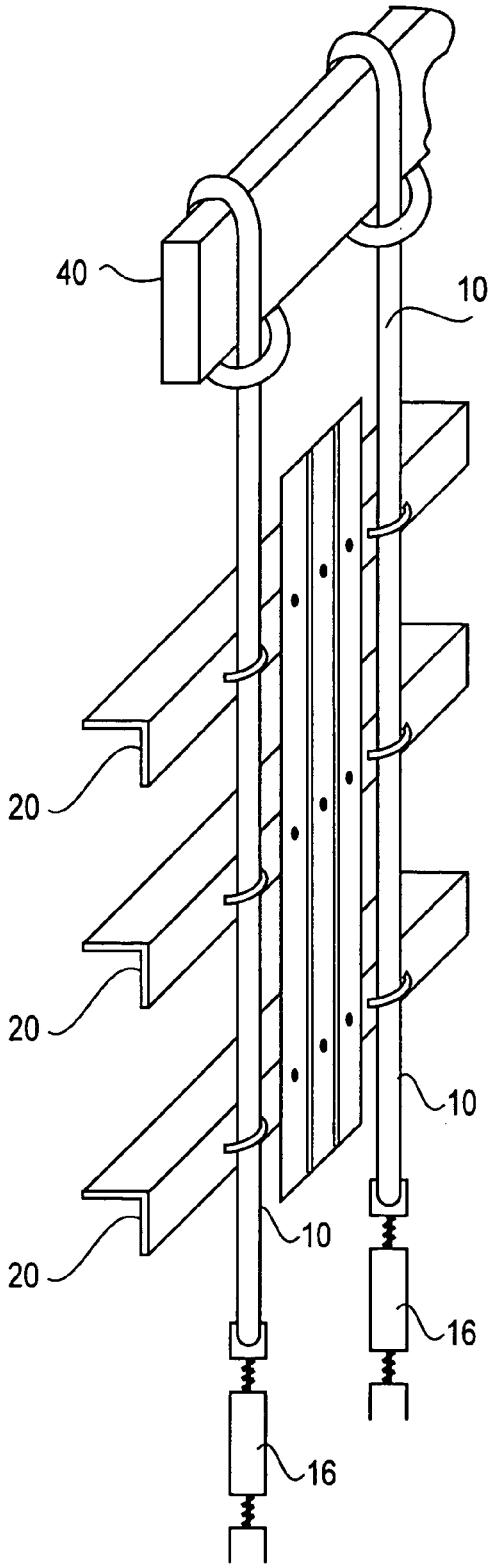
FIG. 13 shows yet another embodiment, comprising a flat-shaped material mounted vertically to angle irons to form a wall.

Another embodiment of the invention is shown in FIG. 13. The cables 10, turnbuckles 16, angle irons 20 and beam 40 are arranged as in FIG. 4 and the other figures. The angle irons may be attached to the cable with Crosby clamps, for example. However, in this case, metal siding or decking or another generally flat-shaped material is mounted vertically to the vertical arms of the angle irons to form a wall. As in the preceding embodiments, the wall sections may be attached to the angle irons with screws, bolts, j-hooks, etc.

The use in this description of such terms as "pipe," "clamp," "plank" and the like is not to be taken as limiting the invention, but rather such terms are to be construed to include all modifications, variations, substitutes and equivalents that would be known to those having the ordinary level of skill in the art.

Although the present invention has been described in relation to particular embodiments thereof, many other variations and modifications and other uses will become apparent to those skilled in the art. Therefore, the present invention is not limited by the specific disclosure herein.

What is claimed is:

1. An arrangement for securing a scaffold stairway to cables, comprising:

a pair of vertically spaced platforms, a stairway extending between the platforms;

each of said platforms having a crosspiece supporting the platform;

said crosspiece having two ends, and a respective cable clamp at each end of each cross piece for being clamped to a respective cable;

wherein said cables extend vertically and said crosspieces extend horizontally; and wherein said platforms extend horizontally and said stairway extends diagonally between said platforms; and each said crosspiece having a pair of crosspiece clamps interconnecting said crosspiece and said platform at respective parts of said crosspiece;

wherein each said cable clamp comprises:

a first fastener for securing the crosspiece to the cable, wherein said first fastener comprises a plate, a cable clamp mounted on one side of the plate, and a crosspiece clamp mounted on the other side of the plate; said crosspiece clamp securing the plate to the crosspiece;

wherein said cable clamp and said crosspiece clamp are spaced away from each other and thereby not directly opposite each other along the length of said plate;

said crosspiece clamp being mounted to said other side of said plate by a rotatable mount, whereby said crosspiece clamp is rotatable on said plate for receiving a crosspiece at a range of angles with respect to the plate;

said first fastener further comprises a second cable clamp mounted on said one side of the plate;

said second cable clamp and said crosspiece clamp are spaced away from each other and thereby not directly opposite each other along the length of said plate;

and said rotatable mount has a bolt extending through said plate.

2. The arrangement of claim 1, wherein each said cable clamp of each said crosspiece is secured directly to a respective cable.

3. The arrangement of claim 1, wherein said crosspiece is a pipe and said crosspiece clamp is a pipe clamp.

4. The arrangement of claim 1, wherein said crosspiece is a pipe, said first fastener being mounted directly to said pipe.

* * * * *